US006269798B1

(12) United States Patent
Takahashi et al.

(10) Patent No.: US 6,269,798 B1
(45) Date of Patent: Aug. 7, 2001

(54) ARRANGEMENT FOR CLAMPING INJECTORS

(75) Inventors: Kouichi Takahashi; Hiroyuki Ichikawa, both of Fujisawa (JP)

(73) Assignee: Isuzu Motors Limited, Tokyo (JP)

( * ) Notice: Subject to any disclaimer, the term of this patent is extended or adjusted under 35 U.S.C. 154(b) by 0 days.

(21) Appl. No.: 09/437,360

(22) Filed: Nov. 10, 1999

(30) Foreign Application Priority Data

Nov. 11, 1998 (JP) ..... 10-320679

(51) Int. Cl.[7] ..... F02M 55/02
(52) U.S. Cl. ..... 123/470; 123/469
(58) Field of Search ..... 123/470, 468, 123/509, 469; 239/533.3

(56) References Cited

U.S. PATENT DOCUMENTS

| | | | | |
|---|---|---|---|---|
| 4,206,725 | * | 6/1980 | Jenkel et al. | 123/32 |
| 4,894,900 | * | 1/1990 | Rausfeisen et al. | 29/256 |
| 5,566,658 | * | 10/1996 | Edwards et al. | 123/468 |
| 5,680,845 | * | 10/1997 | Peng | 123/456 |
| 5,697,345 | * | 12/1997 | Genter et al. | 123/470 |
| 5,878,719 | * | 3/1999 | Nakagomi | 123/470 |
| 5,899,190 | * | 5/1999 | Nakagomi et al. | 123/470 |

FOREIGN PATENT DOCUMENTS

| | | | |
|---|---|---|---|
| 0 320 160 A2 | 11/1988 | (EP) | F02M/61/14 |
| 0 751 290A1 | 1/1997 | (EP) | F02M/61/14 |
| 0 775 820A1 | 5/1997 | (EP) | F02M/61/14 |
| 2213197A * | 8/1989 | (GB) . | |
| 10-176629A | 6/1998 | (JP) | F02M/61/14 |

* cited by examiner

*Primary Examiner*—Henry C. Yuen
*Assistant Examiner*—Mahmoud M. Gimie
(74) *Attorney, Agent, or Firm*—McCormick, Paulding & Huber LLP

(57) ABSTRACT

Two A-shaped brackets for clamping three linearly located injectors onto a cylinder head of an engine. Each bracket has one top branch and two foot branches. Two top branches of the two brackets cooperatively press down a center injector among the three, and two pairs of foot branches of the two brackets press down two side injectors, respectively. Each injector has a flange that is pressed down by the two top branches of the two brackets or the two foot branches of the associated bracket Each bracket has an opening at its approximate center so that a screw shaft extending from the cylinder head can penetrate. Each bracket is secured on a cylinder head by tightening a nut over the screw shaft.

5 Claims, 2 Drawing Sheets

ARRANGEMENT FOR CLAMPING INJECTORS

BACKGROUND OF THE INVENTION

1. Field of the Invention

The present invention generally relates to an arrangement for clamping three neighboring injectors onto a cylinder head of an engine, and more particularly to such an arrangement that is reduced in both weight and manufacturing cost.

2. Description of the Related Art

In general, as illustrated in FIG. 3 of the accompanying drawings, if an engine (diesel or gasoline engine) has an even number of cylinders, each two injectors "a" are first placed in respective holes formed in a cylinder head, and then clamped by an H-shaped bracket "d" which has an opening "b" in its center and two pairs of arms "c" extending in opposite directions from the vicinity of the center opening "b". Each injector "a" has a block-like projection "e" at its top, which provides two flat crescent-shaped areas on both sides of the projection. Each pair of arms "c" of the H-shaped bracket "d" press the two crescent-shaped areas of each injector "a" downwards when the bracket "d" is secured on the cylinder head by threading a nut "g" over a screw shaft "f" extending upwards from the cylinder head. In this manner, each two injectors are clamped at one time. Such an arrangement is disclosed in, for example, Japanese Patent Application, Laid-Open Publication No. 10-176629.

However, if the engine has an odd number of injectors, e.g., three, then the above-described injector clamping arrangement (FIG. 3) is not employable. One possible way of clamping three linearly arranged injectors by a single bracket is illustrated in FIG. 4 of the accompanying drawings. It should be noted here, however, that the arrangement shown in FIG. 4 is not a prior art. The elongated I-shaped bracket "h" clamps the three injectors "a" down, but this elongated bracket "h" would raise a weight and cost. Similar reference numerals are used to designate similar elements in FIGS. 3 and 4, and description of other elements such as "b", "f" and "g" is omitted here.

SUMMARY OF THE INVENTION

An object of the present invention is to provide an arrangement for clamping three neighboring injectors, that is relatively lightweight and requires a less manufacturing cost.

According to one aspect of the present invention, there is provided an arrangement for clamping three linearly positioned injectors onto a cylinder head of an engine, including two "A"-shaped brackets each having one top branch and two foot branches (or forked legs), wherein the two "A"-shaped brackets are arranged in a manner such that two top branches of the two brackets are located adjacent to each other to clamp (or press down) a center injector among the three, and two pairs of foot branches of the two brackets are located apart from each other in opposite directions to clamp two side (or end) injectors, respectively. As compared with a single elongated bracket like that shown in FIG. 4, a weight corresponding to the space between the two brackets is reduced. This also contributes to manufacturing cost reduction since a less amount of material is needed.

The two brackets may possess the same configuration so that a single press machine can be used to make the two brackets. This will also contribute to cost reduction. Each injector may have a transversely extending flange that is pressed down by the two top branches of the two brackets or the two foot branches of the associated bracket. A line connecting the two foot branches of each bracket may extend through a center of the associated injector and a line connecting the two top branches of the two brackets may extend through a center of the center injector. Each bracket may have an opening at its approximate center so that a screw shaft extending from a cylinder head can penetrate therethrough. Each bracket may be secured on the cylinder head by tightening a nut over the screw shaft.

DETAILED DESCRIPTION OF THE INVENTION

Now, an embodiment of the present invention will be described in reference to the accompanying drawings.

Figure 1:
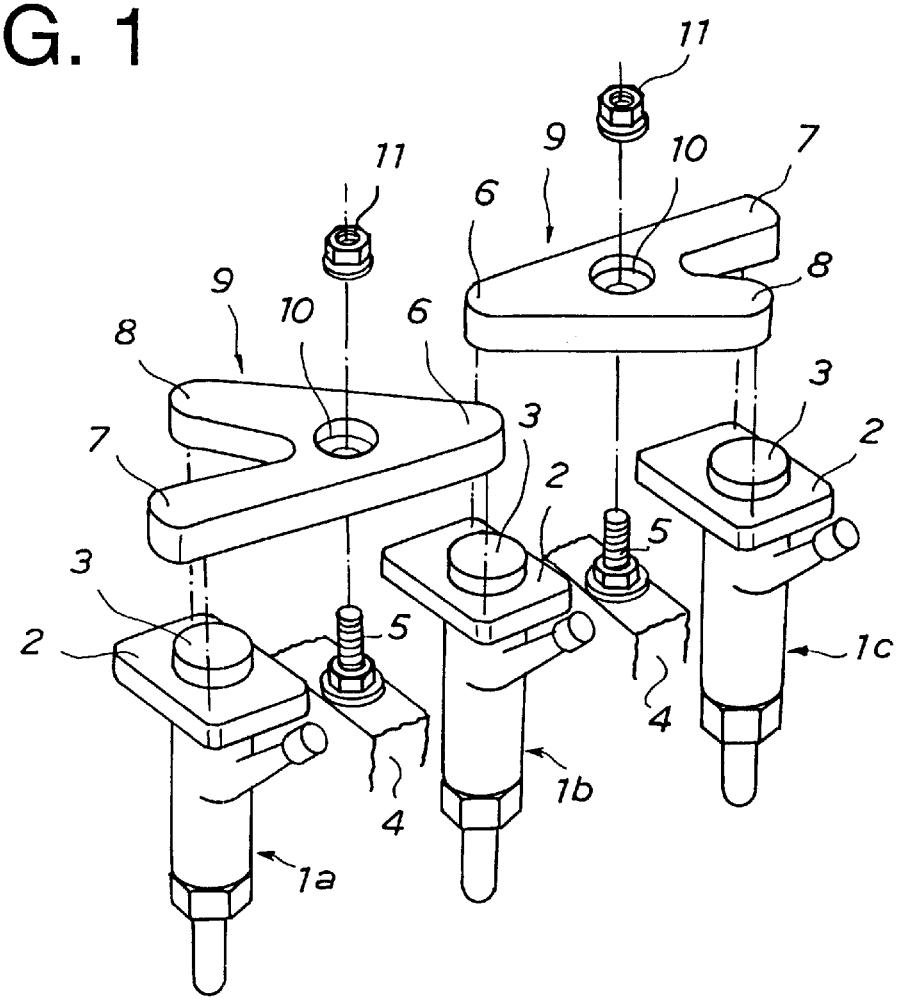
FIG. 1 illustrates a perspective view of an injector clamping arrangement according to the present invention.
Figure 2:
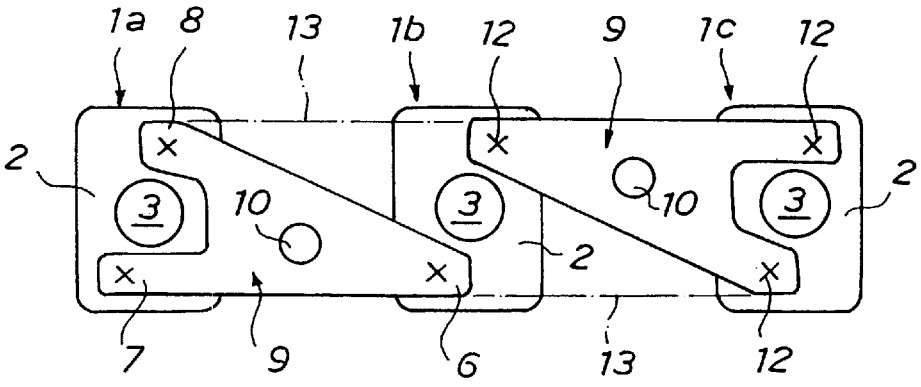
FIG. 2 illustrates a plan view of the arrangement shown in FIG. 1.

Referring to FIGS. 1 and 2, illustrated is an arrangement for fixing three neighboring injectors 1*a*, 1*b*, 1*c* onto a cylinder head 4 of an engine. This engine has three linearly arranged cylinders (not shown). Each of the injectors 1*a*, 1*b*, 1*c* is provided for injecting fuel into an associated cylinder of the engine.

Each of the injectors 1*a*, 1*b*, 1*c* has a flange-like extension 2 near its upper end. At the center of this transversely extending element 2, formed is a coin-like projection 3. Between the three injectors 1*a*, 1*b*, 1*c*, provided are two screw shafts 5 extending upwards from the cylinder head 4. Two "A"-shaped brackets 9 are placed over the three injectors 1*a*, 1*b*, 1*c*. Each of these brackets 9 has one top branch 6 and two leg or foot branches 7, 8. The two brackets 9 are arranged in such a manner that the top branches 6 are positioned close to each other and the foot branches are apart from each other. Each bracket 9 also has an opening 10 at its approximate center. This opening 10 fits over the screw shaft 5, and a nut 11 is tightened over the screw shaft 5.

By threading the nuts 11, the foot branches 7, 8 of the brackets 9 press the flanges 2 of the two side injectors 1*a*, 1*c* downwards against the cylinder head, and at the same time the heads 6 of the two brackets 9 cooperatively press the flange 2 of the center injector 1*b* downwards. As a whole, the three injectors 1*a*, 1*b*, 1*c* inserted in respective bores of the cylinder head 4 are forced down and secured to the cylinder head by the two brackets 9.

Figure 3:
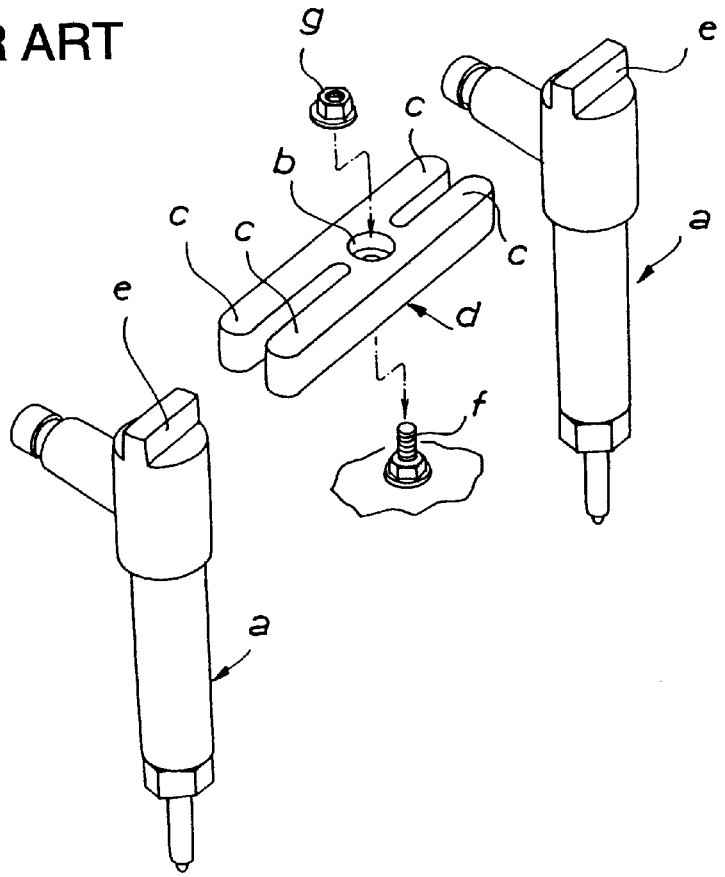
FIG. 3 PRIOR ART
FIG. 3 illustrates a perspective view of a conventional prior art injector clamping arrangement.

As compared with the conventional bracket "d" shown in FIG. 3, which is configured like an "H" and has four dlamping points "c", each of the "A"-shaped brackets 9 of the invention has three clamping points 12. In order to clamp the three injectors, the two brackets 9 provide two clamping points 12 for each of the injectors 1*a*, 1*b*, 1*c*, as designated at "X" in FIG. 2. As understood from the foregoing, the brackets 9 are suited for clamping an odd number of injectors. In other words, the brackets 9 are advantageously used for an engine having an odd number of cylinders.

Figure 4:
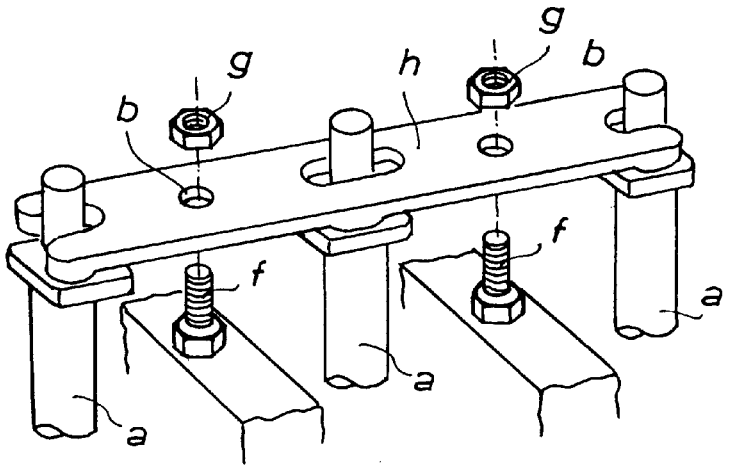
FIG. 4 PRIOR ART
FIG. 4 illustrates another prior art injector clamping arrangement according to a related art.

Now, the weight of the two "A" type brackets 9 of the invention (FIG. 2) is compared with that of the "I" type bracket "h" shown in FIG. 4. As best understood from FIG. 2, the sum of the two "A" type brackets 9 is smaller than the "I" type bracket "h" by the parallelogram 13, i.e., the space between the two brackets 9, as indicated by the imaginary line. Accordingly, the combination of two brackets 9 of the invention is lighter than the single elongated bracket "h" in weight. Of course, a less amount of material is needed to manufacture the brackets 9 than the bracket "h". This also contributes to manufacturing cost reduction.

As depicted in FIG. 2, each pair of clamping points 12 sandwiches the projection 3 of the associated injector so that each bracket 9 can press down the associated injector in an axial direction of the injector in a well balanced manner. Specifically, the three pairs of clamping points 12 are positioned in the same manner for the three injectors 1*a*, 1*b*, 1*c* so that the three injectors are clamped on the cylinder head 4 in the same manner. Further, the distance to any clamping point 12 from the center of the associated injector 3 is the same. In addition, the line connecting each pair of clamping points 12 extends through the center of the associated injector 3.

Since the opening 10 of each bracket 9 is formed at the approximate center of the three clamping points "X" on the top branch 6 and foot branches 7, 8, and the bracket 9 is secured onto the cylinder head 4 at the opening 10 by the nut 11 and the screw 5, the clamping force exerted on the center injector lb by the two top branches 6 of the brackets 9 is substantially equal to that exerted on each of the side injectors 1*a*, 1*c* by the foot branches 7, 8.

Each bracket 9 has a substantially right-angled triangle shape, with some portions being cut out. The illustrated two brackets 9 have the same configuration. Therefore, it is possible to manufacture the brackets 9 by a single press machine. This also contributes to cost reduction.

The foregoing description deals with the engine having three cylinders. However, it should be noted that the teaching of the present invention is also applicable to a five-cylinder engine. In this case, a pair of brackets 9 shown in FIGS. 1 and 2 is utilized for fixing three injectors and another bracket "d" shown in FIG. 3 may be utilized for fixing two injectors. Of course, two pairs of brackets 9 may be employed if the engine has six cylinders.

The illustrated and described arrangement is disclosed in Japanese Patent Application No. 10-320679 filed on Nov. 11, 1998, the instant application claims priority of this Japanese Patent Application, and the entire disclosure thereof is incorporated herein by reference.

What is claimed is:

1. An arrangement for clamping three injectors onto a cylinder head wherein the three injectors are located a common line and consist of two side injectors and one center injector, said arrangement comprising two "A"-shape brackets separate from one another and each having one top branch and two foot branches, wherein each of the two separate "A"-shaped brackets is disposed such that its top branch is adjacent to and clamps the center injector and its two foot branches are adjacent to and clamp a respectively associated one of the two side injectors.

2. The arrangement according to claim 1, wherein the two "A"-shaped brackets possess the same configuration.

3. The arrangement according to claim 2, wherein a line connecting the two foot branches of each "A"-shaped bracket extends through a center of the associated one of the side injectors and a line connecting the two top branches of the two "A"-shaped brackets extends through a center of the center injector.

4. The arrangement according to claim 3, wherein each "A"-shaped bracket includes an opening at its approximate center so that a screw shaft extending from a cylinder head can penetrate therethrough.

5. The arrangement according to claim 4, wherein each "A"-shaped bracket is secured on the cylinder head by tightening a nut over the screw shaft.

* * * * *